United States Patent [19]

Tani

[11] 3,970,459

[45] July 20, 1976

[54] PROCESS FOR DEVELOPING A DIRECT REVERSAL SILVER HALIDE PHOTOGRAPHIC LIGHT-SENSITIVE MATERIAL

[75] Inventor: Tadaaki Tani, Minami-ashigara, Japan

[73] Assignee: Fuji Photo Film Co., Ltd., Minami-Ashigara, Japan

[22] Filed: Sept. 10, 1974

[21] Appl. No.: 504,775

Related U.S. Application Data

[63] Continuation-in-part of Ser. No. 281,674, Aug. 18, 1972, abandoned.

[30] Foreign Application Priority Data

Aug. 19, 1971 Japan ..... 46-63229

[52] U.S. Cl. ..... 96/64; 96/66.3; 96/101

[51] Int. Cl.[2] ..... G03C 5/24

[58] Field of Search ..... 96/64, 101, 66.3

[56] References Cited

UNITED STATES PATENTS

| | | | |
|---|---|---|---|
| 3,501,305 | 3/1970 | Illingsworth | 96/101 |
| 3,501,306 | 3/1970 | Illingsworth | 96/101 |
| 3,501,307 | 3/1970 | Illingsworth | 96/101 |
| 3,615,517 | 10/1971 | Milton et al. | 96/64 |
| 3,687,674 | 8/1972 | Sato et al. | 96/101 |

*Primary Examiner*—Edward G. Whitby

*Attorney, Agent, or Firm*—Sughrue, Rothwell, Mion, Zinn & Macpeak

[57] ABSTRACT

A process for developing a light-sensitive material which comprises processing a direct reversal silver halide photographic light-sensitive material comprising a support having thereon a silver halide photographic emulsion comprising 1. cubic silver halide grains having fogging nuclei therein provided by adding a strong reducing agent to the emulsion and ripening the emulsion, and

2.

a. a compound acting as an electron acceptor being capable of receiving photoelectrons and also acting as a development accelerator bearing atoms capable of being positively charged in a developer or b. a compound as an electron acceptor capable of receiving photoelectrons and a compound as a development accelerator bearing atoms capable of being positively charged in a developer in an aqueous solution of a hydrophilic colloid with a developer containing a developing agent bearing atoms capable of being negatively charged in the developer is disclosed.

24 Claims, 2 Drawing Figures

PROCESS FOR DEVELOPING A DIRECT REVERSAL SILVER HALIDE PHOTOGRAPHIC LIGHT-SENSITIVE MATERIAL

CROSS REFERENCE TO RELATED APPLICATION

This application is a continuation-in-part of U.S. application Ser. No. 281,674, filed Aug. 18, 1972, by Tadaaki Tani, and entitled "Process for Developing a Direct Reversal Silver Halide Photographic Light-Sensitive Material", now abandoned.

BACKGROUND OF THE INVENTION

1. FIELD OF THE INVENTION

The present invention relates to a process for developing a direct reversal silver halide photographic light-sensitive material which provides enhanced reversal sensitivity.

2. DESCRIPTION OF THE PRIOR ART

A number of direct reversal silver halide photographic light-sensitive materials or processing methods therefor have heretofore been known. However, in most of them, a light-sensitive material in which silver halide grains have been provided previously with fogging nuclei is imagewise exposed through a positive image to thereby destroy the fogging nuclei in proportion to the exposure by the action of positive holes, halogen atoms or molecules, dye oxides (dye positive holes), etc. produced by exposure, and subsequently subjecting the material to a developing step to form directly a positive (reversal) image on the light-sensitive material.

Therefore, in this type of direct reversal photographic light-sensitive materials, it is required for the previously formed fogging nuclei to be easily destroyed by the positive holes, halogen atoms or molecules, dye oxides, etc. and to have high development activity in order to provide enhanced reversal sensitivity. However, in general, fogging nuclei with high development activity tend to be difficult to destroy, and hence it is extremely difficult under existing circumstances to form fogging nuclei appropriate for a direct reversal photographic light-sensitive material with a high sensitivity. In fact, the sensitivity of a conventional direct reversal photographic light-sensitive material is less than 1/100 of that of a usual silver halide light-sensitive material.

Hence, to enhance the development activity of fogging nuclei without complicating the development processing step the addition to an emulsion of various compounds which are used in intensifying latent images, such as a gold compound, together with a fogging nuclei-forming agent might be considered. However, using such an approach, the fogging nuclei are difficult to destroy, and hence it is impossible to enhance markedly the reversal sensitivity.

SUMMARY OF THE INVENTION

The present invention has solved the above-described problems experienced in the conventional direct reversal silver halide photographic light-sensitive material and the developing process therefor.

The process of the present invention comprises processing a direct reversal silver halide photographic light-sensitive material comprising a support having thereon a silver halide photographic emulsion comprising 1. cubic silver halide grains having fogging nuclei therein provided by the addition of a strong reducing agent and the ripening of the emulsion;

2. (a) a compound acting as an electron acceptor being capable of receiving photoelectrons and also acting as a development accelerator bearing atoms capable of being positively charged in a developer or b. a compound as an electron acceptor capable of receiving photoelectrons and a compound as a development accelerator bearing atoms capable of being positively charged in a developer, in an aqueous solution of a hydrophilic colloid with a developer containing a developing agent bearing atoms capable of being negatively charged in the developer.

BRIEF DESCRIPTION OF THE ACCOMPANYING DRAWINGS

DETAILED DESCRIPTION OF THE INVENTION

Figure 1:
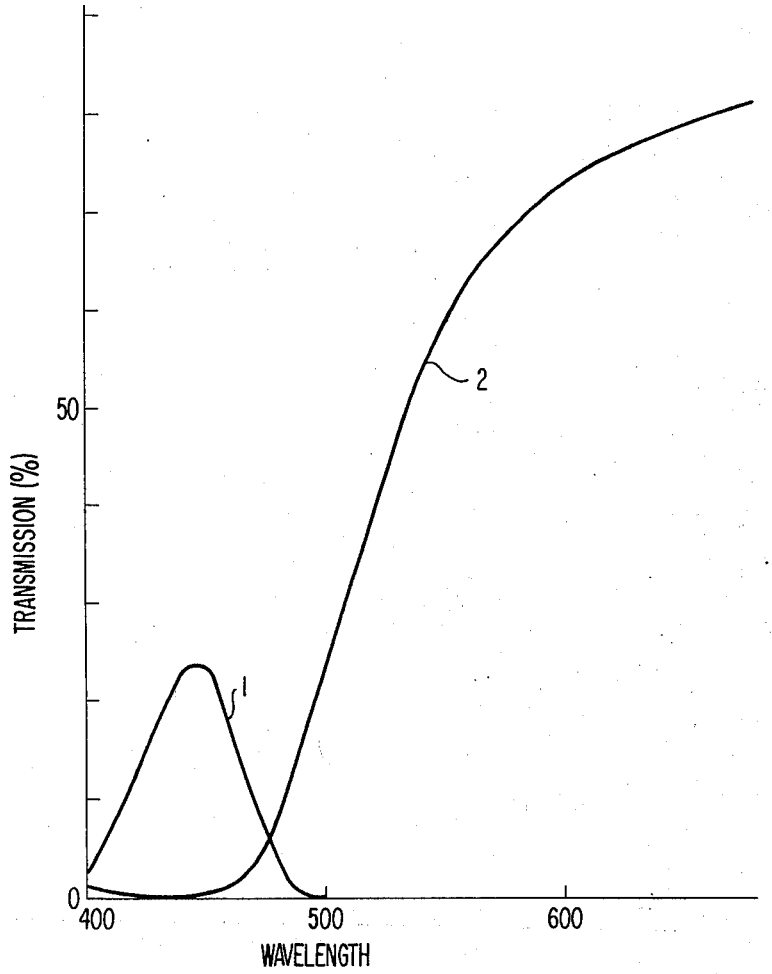
FIG. 1 is a graph showing the relationship between the wavelength of light and the percent transmission of the filter used in the exposure in the Examples of the invention, wherein Curve 1 corresponds to the blue filter and Curve 2 to the yellow filter.

The invention will be described in detail hereinafter.

First, illustrating the direct reversal silver halide photographic light-sensitive material used in the invention, the light-sensitive material comprises a support material for maintaining the form of the light-sensitive layer coated thereon. Suitable such support are various papers, e.g., base supports, baryta papers, resin-coated papers, etc., film-shaped or sheet-shaped moldings of various synthetic resins, e.g., polyethylene terephthalate, cellulose diacetate, cellulose triacetate, polycarbonate, polyvinyl chloride, etc., glass plates and laminates of various materials. The light-sensitive layer is coated on the surface thereof. If necessary, the light-sensitive layer is coated on the support provided with a subbing layer in order to enhance the adhesion therebetween.

The light-sensitive layer of the light-sensitive material in the invention is formed by applying to a support a silver halide photographic emulsion containing the above-described components (1) to (3) in an aqueous solution of a hydrophilic colloid comprising gelatin, polyvinyl alcohol, polyvinyl pyrrolidone or carboxymethyl cellulose, or a combination of gelatin and polyvinyl alcohol, polyvinyl pyrrolidone, carboxymethyl cellulose or the like. The constitution of the emulsion is extremely important for the invention.

The above-described component (1) is cubic silver halide grains provided with fogging nuclei by the addition of a strong reducing agent and the ripening of the emulsion. Although silver halide grains can take various forms such as a cube, an octahedron, etc., cubic silver halide grains are the most effective for the invention. It has been clarified by the inventor's investigations that the action of a spectrally sensitizing agent for direct reversion can be enhanced by using this form of silver halide. Silver halide grains in the cubic form are described, for example, in The Theory of the Photographic Process, 3rd Ed. (compiled by C. E. K. Mees and T. H. James), Chap. 2, and the process for producing the same is described in a paper by C. R. Berry and D. C. Skillman reported in the Journal of Photographic Science and Engineering Vol. 6, No. 3 under the title of "Precipitation of Twinned AgBr Crystals". Cubic silver halide crystals are thus well known to those skilled in the art.

The following outlines a process for producing such grains, in the production of silver halide by the reaction between a water-soluble silver salt and a water-soluble halide in an aqueous solution of a hydrophilic colloid, a double-run method (i.e., a method of simultaneously pouring an aqueous solution of the water-soluble silver salt and an aqueous solution of the water-soluble halide into an aqueous solution of a hydrophilic colloid solution while stirring) is employed maintaining the pAg of the reaction solution within the range of from about 7.1 to about 9.2. This pAg value varies depending upon the silver halide produced. Accordingly, for example, the pAg value is adjusted in general to 8.6 to 9.2 for silver bromide, to about 7.9 for silver chlorobromide and to about 7.1 for silver chloride. The pH of the reaction solution is maintained less than about 9.7, preferably less than 4, by the addition of acids such as sulfuric acid. The reaction temperature can range from about 30° to about 90°C.

Silver halide grains having a mean grain diameter, i.e., an average grain size in the range of below about 3 microns, preferably about 0.1 to about 1 micron, give particularly good results.

Silver halide grains included in a light-sensitive silver halide emulsion used in the present invention are principally cubic, but grains in other crystal forms may be present in the emulsion. However, the proportion of the cubic grains must be at least about ⅔ or greater, desirably at least about 9/10 or greater, based on the total weight of the silver halide grains.

To the silver halide emulsion thus prepared is added a strong reducing agent, and the emulsion is then ripened thereby to form fogging nuclei in the silver halide grains. Suitable strong reducing agents which can be used are the hydrazines described in U.S. Pat. Nos. 3,062,651 and 2,983,609; the phosphonium salts such as tetra(hydroxymethyl)phosphonium chloride; thiourea dioxide; stannous salts such as stannous chloride described in U.S. Pat. No. 2,487,850; polyamines such as diethylene triamine described in U.S. Pat. No. 2,519,698; polyamines such as spermine described in U.S. Pat. No. 2,521,925; bis($\beta$-aminoethyl)sulfite and the water soluble salt thereof described in U.S. Pat. No. 2,521,926; and the like.

These strong reducing agents can be used alone or in combination, and are added in an amount of less than $0.06 \times 10^{-3}$ mol, generally from about 0.0005 to $0.06 \times 10^{-3}$ mol, preferably from about 0.001 to about $0.03 \times 10^{-3}$ mol, per mol of silver halide.

Ripening of the silver halide emulsion in which the strong reducing agent is incorporated may satisfactorily be conducted in any conventionally known manner such as those disclosed in U.S. Pat. Nos. 3,501,306, 3,501,307, 3,501,310, etc., and requires no special conditions or considerations for carrying out the invention.

After the ripening of the emulsion, the fogging nuclei are formed in the silver halide grains contained therein.

Next, illustrating the compounds referred to herein by the term "electron acceptor" which are added to a ripened emulsion, these electron acceptors are compounds capable of receiving photoelectrons. Some of them are known as desensitizing dyes, but the electron acceptors cannot be defined unequivocally. However, the electron acceptor can be said to be, for example, a substance in which the sum of the oxidation potential and reduction potential measured by polarography is positive. Specific examples of these electron acceptors are illustrated by the cyanine dyes as described in Belgian Pat. No. 660,253, especially the imidazoquinoxaline dyes. Of these cyanine dyes, those substituted by an aromatic ring at the 2-position of the indole nucleus exhibit markedly preferable results. Furthermore, there are illustrated bis(1-alkyl-2-phenylindole-3)-trimethinecyanine as described in U.S. Pat. No. 2,930,694; dimethinecyanine dyes as described in British Pat. No. 970,601; dyes having a seven membered ring as described in Belgian Pat. No. 758,899, German Offenlegungsschrift No. 2,055,752 and French Pat. No. 3,080,881; cyanine dyes in which at least one nucleus, preferably two nuclei thereof, bear a desensitizing group such as $NO_2$, as described in British Pat. No. 723,019; cyanine dyes such as *3,3'-diethyl-6,6'-dinitrothiacarbocyanine chloride; dyes containing a 7-membered ring such as those described in Belgian Pat. No. 758,899, German Offenlengungsschrift No. 2,055,752 and French Pat. No. 2,080,881; and the like. (The use of the asterisk preceding the names of the dyes given herein will be described hereinafter).

Illustrating specific examples of these compounds, there are *1,1-dimethyl-2,2'-diphenyl-3,3'-indolocarbocyanine bromide; *2,2'-di-p-methoxyphenyl-1,1'-dimethyl-3,3'-indolocarbocyanine bromide; *1,1'-dimethyl-2,2', 8-triphenyl-3,3'-indolocarbocyanine perchlorate; *1,1',3,3'-tetraethylimidazolo-(4,5-b)-quinoxalinocarbocyanine chloride; *phenosafranine; *pinakryptol yellow; *1,3-diethyl-6-nitrothia-2'-cyanine iodide; *3,3'-diethyl-6,6'-dinitro-9-phenylthiacarbocyanine iodide; *Crystal Violet; *3,3'-diethyl-6,6'-dinitrothiacarbocyanine ethylsulfate; *1',3-dimethyl-6-nitrothia-2'-cyanine iodide; *3,3'-di-p-nitrobenzylthiacarbocyanine bromide; *3,3'-di-p-nitrophenylthiacarbocyanine iodide; *3,3'-di-o-nitrophenylthiacarbocyanine perchlorate; 3,3'-dimethyl-9-trifluoromethylthiacarbocyanine iodide; *9-(2,4-dinitrophenylmercapto)-3,3'-diethylthiacarbocyanine iodide; *bis(4,6-diphenylpyrryl-2) trimethinecyanine perchlorate; the compounds represented by the general formula:

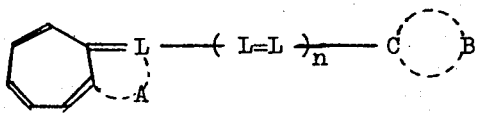

wherein A represents the non-metallic atoms necessary to complete a 5-membered heterocyclic nucleus, *n* represents 0,1 or 2, L represents a methine group and B represents the non-metallic atoms necessary to complete a basic nitrogen containing heterocyclic nucleus, such as

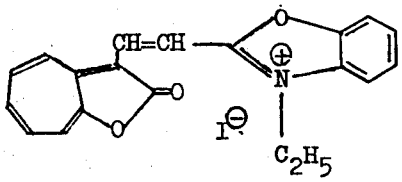

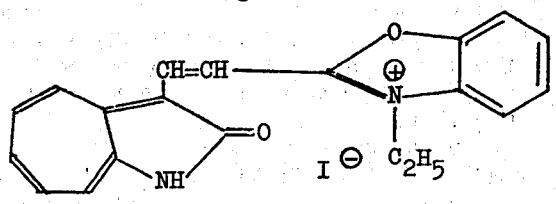

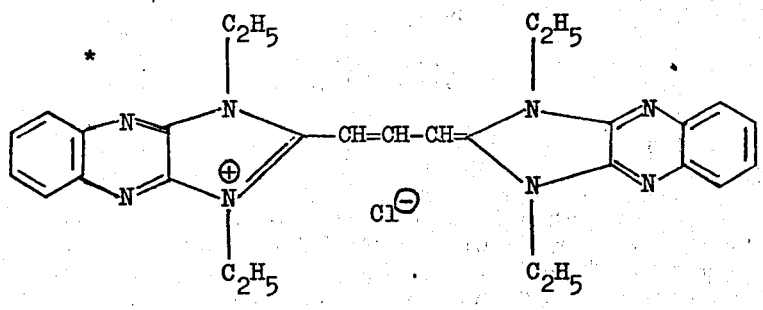

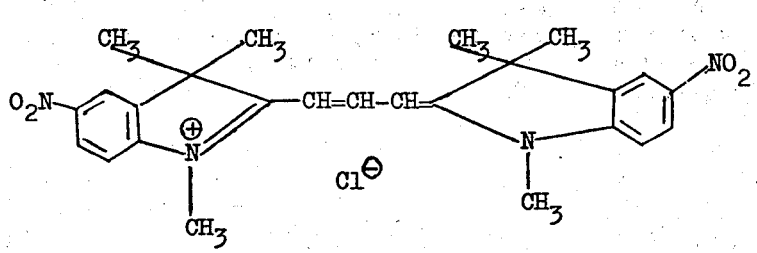

5-m-nitrobenzylidenerhodanine; 5-m-nitrobenzylidene-3-phenylrhodanine; 3-ethyl-5-m-nitrobenzylidenerhodanine; 3-ethyl-5-(2,4-dinitrobenzylidene)rhodanine; 5-o-nitrobenzylidene-3-phenylrhodanine; 6-chloro-4-nitrobenzotriazole; 2-(p-dimethylaminophenyliminomethyl)-benzothiazole ethoethylsulfate; 1,3-diamino-5-methylphenazinium chloride; 4-nitro-6-chlorobenzotriazole; anhydro-2-p-dimethylaminophenyliminomethyl-6-nitro-3-(4-sulfobutyl)-benzothiazoline hydroxide; 1-(2-benzothiazolyl)-2-(p-dimethylaminostyryl)-4,6-diphenylpyridine iodide; 1,3-diethyl-5-[1,3-neopentylene-6-(1,3,3-trimethyl-2-indolinylidene)-2,4-hexadienylidene]-2-thiobarbituric acid; 2,3,5-triphenyl-2H-tetrazolium chloride; 2-(4-iodophenyl)-3-(4-nitrophenyl)-5-phenyl-tetrazolium chloride; 1-methyl-8-nitroquinolinium methylsulfate; 3,6-bis[4-(3-ethyl-2-benzothiazolinylidene)-2-butenylidene]-1,2,4,5-cyclohexanetetrone; and the like. The proportion of these electron acceptors added can range from about 100 mg to 2 g per 1 mole of silver halide.

To the emulsion is further added a development accelerator. Such development accelerators bear a group capable of being positively charged at least in a developer. For example, the development accelerators having a nitrogen atom positively charged can be included in the emulsion. (The counter ion such as $Cl^{\ominus}$ or $I^{\ominus}$ is immaterial since the negative ion does not play an important role.) These development accelerators have the function of accelerating the development when the development is conducted in a developer containing the developing agent described hereinafter. The proportion of the development accelerator added can range from 0.01 g to 2 g, preferably from 0.1 g to 1 g, per one mole of silver halide.

As specific examples of the development accelerators, there are illustrated the compounds marked hereinbefore with an asterisk (*) among the specific compounds of the electron acceptors illustrated above, and, in addition, the compounds represented by the following general formulae (I) to (III) can be preferably used.

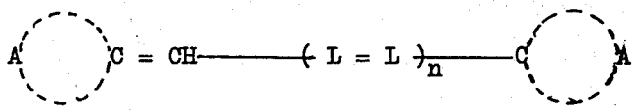

(I)

wherein A and A′ each represents the atoms necessary to complete a nitrogen-containing basic heterocyclic nucleus such as quinoline, pyridine, thiazole, benzthiazole, oxazole, benzoxazole, selenazole, benzselenazole, naphthoselenazole, naphthothiazole, naphthoxazole and the like, L represents a methine group, and n represents 0, 1 or 2.

Specific examples of the compounds of the general formula (I) include 3,3′-diethyl-thiacarbocyanine iodide; 3,3′-diethyloxacarbocyanine iodide; 3,3′-diethylselenadicarbocyanine iodide; 3,3′-diethyl-2,2′-quinocarbocyanine iodide; 3,3′-diethylnaphthoxadicarbocyanine iodide; 3,3′-diethyl-oxacyanine iodide; 3,3′-diethylnaphthoselenacyanine iodide; 3,3′-diethyl-mesomethyl-thiacarbocyanine iodide; 3,3′-diethyl-mesophenyl-oxacarbocyanine iodide, 3,3′-diethyl-mesopropyl-2,2′-quinocarbocyanine iodide; 3,3′-diethylmesomethyloxa-dicarbocyanine iodide; 3,3′-diethyl-mesomethylnaphthoxadicarbocyanine iodide; 3,3′-diethyl-5,5′-dichloro-thiacarbocyanine iodide; 3,3′-diethyl-5,5′-diethyloxacarbocyanine iodide; 3,3′-diethyl-5,5′-diphenyl-oxadicarbocyanine iodide, 3,3′-diethyl-6,6′-dimethoxy-oxadicarbocyanine iodide;

3,3′-diethyl-6,6′-diethoxyselenadicarbocyanine iodide; and the like.

Although the above-described compounds are all illustrated as the iodide form, the chloride or the perchlorate form may also be used.

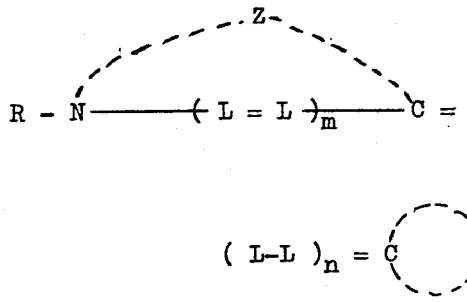

wherein R represents a substituted alkyl group such as a sulfoalkyl group, for example, sulfopropyl and sulfobutyl, a sulfatoalkyl group, for example, sulfatopropyl and sulfatobutyl and a carboxyalkyl group, for example, carboxyethyl and carboxybutyl, and the like, or an unsubstituted alkyl group having 1 to 8 carbon atoms such as methyl, ethyl, butyl, octyl and the like, L represents a substituted or unsubstituted methine chain, m represents 0 or 1, n represents 0, 1 or 2, Z represents the non-metallic atoms necessary to complete a heterocyclic nucleus, and B represents the non-metallic atoms necessary to complete a nitrogen-containing basic heterocyclic nucleus.

As specific examples of the compounds represented by the above general formula (II), there are illustrated the compounds represented by the following formula;

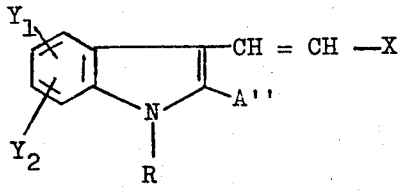

wherein R is as defined above, A″ represents an aryl group such as phenyl or substituted phenyl wherein the substituent is an alkyl group, e.g., methyl, ethyl, propyl, butyl, or the like, an alkoxy group, e.g., methoxy, ethoxy, propoxy, butoxy, or the like, a halogen atom, e.g., bromine, chlorine, iodine or the like, $Y_1$ and $Y_2$ each represents a hydrogen atom, a methyl, an ethyl, methoxy or ethoxy group, and X represents a substituent such as

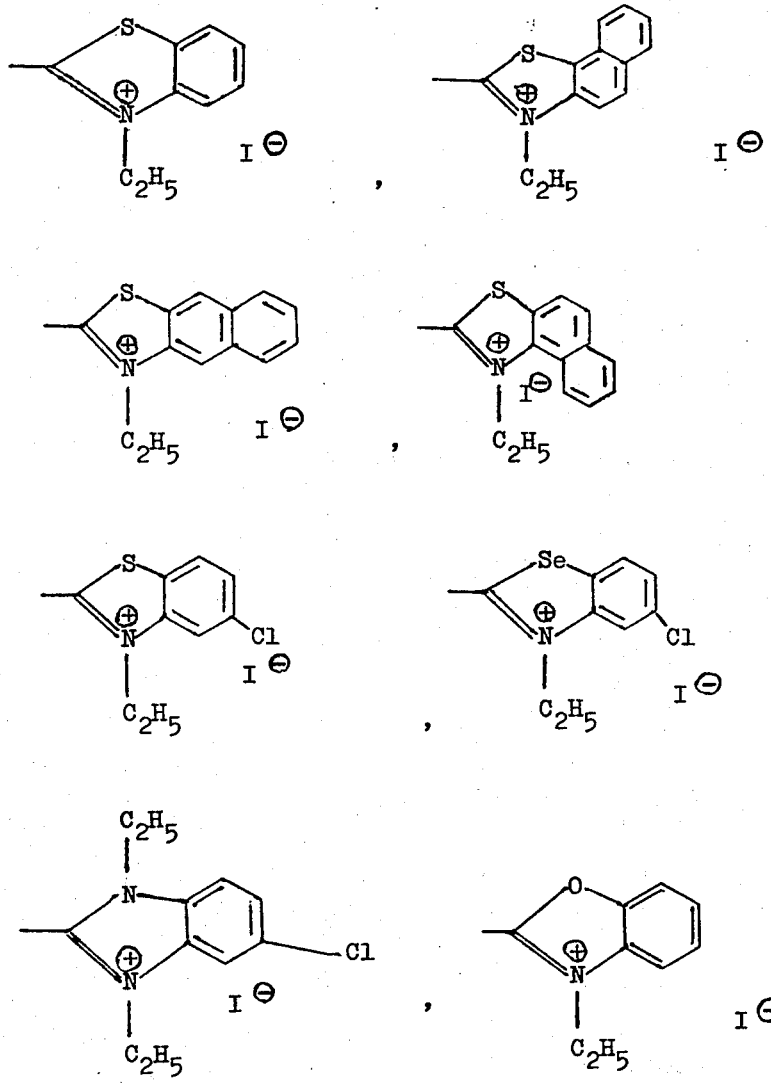

—Continued

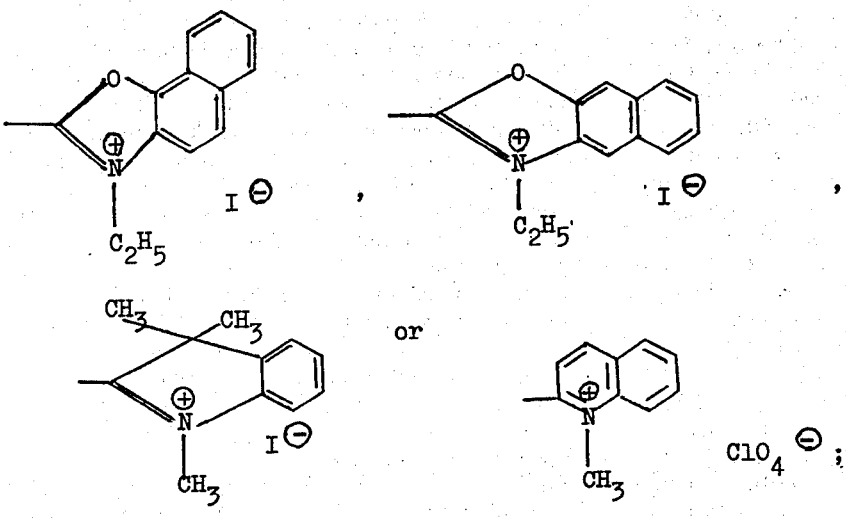

or a group represented by the formula

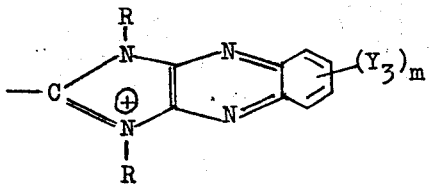

wherein R represents an alkyl or aryl group, n represents 0 or 1, m represents 0, 1 or 2, Z represents the non-metallic atoms necessary to complete a 5- or 6-membered heterocyclic nucleus, Q represents the non-metallic atoms necessary to complete a 5-membered heterocyclic nucleus.

Further, additional specific examples can be represented by the following formula;

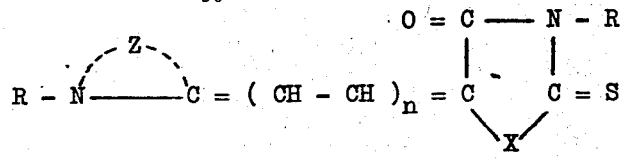

(III")

wherein R is as defined above, $Y_3$ represents a halogen atom, —CN or —$NO_2$, and n is 0 to 3, and the like.

The sensitivity of the light-sensitive material used in the invention can be enhanced further by the addition of a spectrally sensitizing agent to the light-sensitive layer therein. Such spectrally sensitizing agents can be defined as compounds showing an oxidation potential of less than 0.8 V and a reduction potential of less than −1.0 V. The proportion of the spectrally sensitizing agent added can range from $10^{-2}$ to $10^{-5}$ mole, preferably from $10^{-3}$ to $10^{-4}$ mole per 1 mole of silver halide.

As representatives of spectrally sensitizing agents, the compounds of the following general formula;

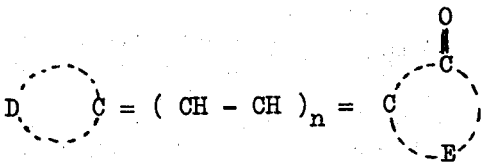

(III)

wherein D represents the atoms necessary to complete a nitrogen-containing basic heterocyclic nucleus, E represents the atoms necessary to complete an acidic heterocyclic nucleus, and n represents 1, 2 or 3, are preferably used as well as the foregoing compounds represented by the general formulae (I) and (II) used as development accelerators.

Additional specific examples of the compounds (III) are represented by compounds having the following formula;

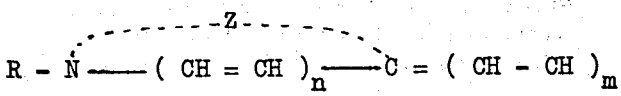

(III')

wherein R represents an alkyl or aryl group, n represents 1 or 2, Z represents the non-metallic atoms necessary to complete a 5- or 6- membered heterocyclic nucleus, and X represents an oxygen atom, a sulfur atom or a selenium atom or a NR′ group, R′ being an alkyl or aryl group.

Specific examples of these compounds are: 3-carboxymethyl-5-[(3-ethyl-2-benzothiazolinylidene)-ethylidene]rhodanine, 3-ethyl-5-[(3-ethyl-2-benzothiazolinylidene)-ethylidene]rhodanine, 3-(2-dimethylaminoethyl)-5-[4-(3-ethyl-2-benzothiazolinylidene)-2-butenylidene]rhodanine, 3-ethyl-5-[(3-ethyl-2-benzoxazolinylidene)-ethylidene]rhodanine, 3-carboxymethyl-5-[(3-ethyl-2-benzoxazolinylidene)ethylidene]rhodanine, 3-carboxymethyl-5-[(3-methyl-2-thiazolinylidene)-1-methylethylidene]rhodanine, 3-carboxymethyl-5-(3-ethyl-4-methyl-4-thiazoline--thazoline-2-ylidene)rhodanine, sodium 5-[(3-methyl-2-thiazolinylidene)-1-methylethylidene]-3-(2-sulfoethyl)-rhodanate, 3-ethyl-5-[1-(4-sulfobutyl)-4(1H)-pyridylidene]rhodanine, 3-ethyl-5-(1-ethyl-4(1H)-pyridylidene)rhodanine, 3-ethyl-5-[(3-ethyl-2-benzothiazolinylidene)ethylidene]-2-thio-2,4-oxazolidinedione, 3-carboxymethyl-5-[(3-ethyl-2-benzoxazolinylidene)ethylidene]-2-thio-2,4-oxazolidinedione, 3-carboxymethyl-5-[(3-ethyl-2-benzoxazolinylidene)-ethylidene-2-thio-2,4-oxazolidinedione, 3-ethyl-5-[(3-ethylnaphtho [2,1-d]oxazolin-2-ylidene)ethylidene]-2-thio-2,4-oxazolidinedione, 1-carboxymethyl-5-[(3-ethyl-2-benzothiazolinylidene)-ethylidene-3-phenyl-2-thiohydantoin, 1-carboxy-5-[(1-ethylnaphtho[1,2-d]thiazolin-2-ylidene)ethylidene]-3-phenyl-2-thiohydantoin, 3-heptyl-5-(1-methylnaphtho[1,2-d]thiazolin-2-ylidene)-1-phenyl-2-thiohydantoin, 5[4-(3-ethyl-2-benzoxazolinylidene)-2-butenylidene]-1,3-diphenyl-2-thiohydantoin, 4-[(1-ethylnaphtho[1,2-d]thiazolin-2-ylidene)-1-methylethylidene]-3-methyl-1-(4-sulfophenyl)-2-pyrazolin- 5-one, 1-ethyoxycarbonylmethyl-5-[(1-ethylnaphtho[1,2-d]-thidazolin-2-ylidene)-ethylidene]-3-(4-nitrophenyl)-2-thiohydantoin, 5-[4-(3-ethyl-2-benzothiazolinylidene)-2-butenylidene]-3-heptyl-2-thio-2,4-oxazolidinedione, 5-[(1,3-diarylimidazo[4,5-b]quinoxalin-2(3H)-ylidene)ethylidene]-3-ethylrhodanine, 3-ethyl-5-[(3-methyl-2-thiazolinylidene)-ethylidene]-2-thio-2,4-oxazoldinedione, 5-[(3-(2-carboxyethyl)-2-thiazolidinylidene)-ethylidene]-3-ethylrhodanine, 5-[(3-methyl-2-thiazolinylidene]-3-(2-morpholinoethylrhodanine, 5-[(3-(2-carboxyethyl)-2-thiazolinylidene)-1-methylethylidene]-3-carboxymethyl-rhodanine, 5-[(3-(2-carboxyethyl)-2-thiazolidinylidene)-1-methylethylidene]-3-(2-methoxyethyl)rhodanine, 3-(3-dimethylaminopropyl)-5-[(3-methyl-2-thiazolinylidene)ethylidene]rhodanine, and the like.

To the light-sensitive layer of the light-sensitive material used in the invention may further be added, in addition to the above-described components, such additives as coating aids, for example, wetting agents described in B. M. Deryagin and S. M. Levi, Film Coating Theory, the Focal Press, London, New York (1964), pp. 137–183; stabilizing agents and fog inhibitors such as those described in F. W. H. Mueller, Review of Mechanism of Emulsion Stabilizers and Antifogging Agents, in The Photographic Image, Formation and Structure (International Congress of Photographic Science, Tokyo, 1967), (compiled by S. Kikuchi), The Focal Press, London, New York (1970), pp. 91–106; antistatic agents such as saponin and its derivatives, and alkyl-benzimidazolesulfonic acids and their derivatives disclosed in U.S. Pat. No. 3,457,076; hardeners, hardening accelerators and swelling inhibitors such as those described by J. Pouradier and D. M. Burness in The Theory of the Photographic Process(-Third Edition), (compiled by C. E. K. Mees and T. H. James), Macmillan Co., New York (1966), pp. 54–60; couplers such as those described by A. Weissberger in The Theory of the Photographic Process (Third Edition), (compiled by C. E. K. Mees and T. H. James), Macmillan Co., New York (1966), pp. 382–396, and A. Weissberger, A Chemist's View of Color Photography in American Scientist, Vol. 58, No. 6, 1970, pp. 648–660, and other additives.

The developing solution employed in the present invention contains a developing agent having at least one-phenolic hydroxyl group and is a solution (generally an aqueous solution) having a pH value not less than 11.0. The type of compounds used as a developing agent are disclosed in L. F. A. Mason Photographic Processing Chemistry (The Focal Press, New York) and C. E. K. mees and T. H. James The Theory of the Photographic Process 3rd Edition (The Macmillan Company, New York), and are well known to one skilled in the art. Of these developing agents, those having more than one phenolic hydroxyl group are employed in our invention.

Specifically useful developing agents are as follows: hydroquinones such as, for example, hydroquinone, phenylhydroquinone, 2′-hydroxyphenylhydroquinone, phenoxyhydroquinone, 4′-methylphenylhydroquinone, 1,4-dihydroxynaphthalene, 2-(4-aminophenethyl)-5-bromohydroquinone, 2-(4-aminophenethyl)-5-methylhydroquinone, 4′-aminophenethylhydroquinone, 2,5-dimethoxy-hydroquinone, 2,5-dibutoxyhydroquinone, mxylohydroquinone, bromo-hydroquinone, 3,6-dichlorohydroquinone, 2-dimethylaminomethylhydroquinone, hydroquinone, 2-cyclohexylhydroquinone, sec-butylhydroquinone, 2,5-di-chlorohydroquinone, 2,5-diisopropylhydroquinone, 2,5-diiodohydroquinone, 3-chlorotoluhydroquinone, tetrachlorohydroquinone, 2,5-diphenylhydroquinone, 2,5-diresorcilhydroquinone, 2,5-dioctyl-hydroquinone, dodecylhydroquinone, catechols such as, for example, catechol, 4-methylcatechol, 4-iso-propylcatechol, 3-isopropylcatechol 4-tert-butylcatechol, 4-phenylcatechol, 3,6-dimethylcatechol, 3-phenylcatechol, 4-octylcatechol, p-chlorocatechol, 4,5-dibromocatechol, 4-phenoxy-catechol, hexanoylcatechol, disodium catechol disulphinate, 4-phenylcatechol carbonate, caffeic acid, 3,4-dihydroxycinnamic acid, nordihydroquiaretic acid, etc., pyrogallols such as, for example, pyrogallol, gallacetophenone, methyl gallate, ethyl gallate, etc; those compounds represented by the following general formula:

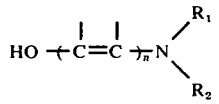

wherein

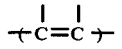

can be a part of a ring such as an aromatic ring (e.g., a benzene ring, a naphthalene ring, etc., or a heterocyclic ring (e.g., a hydrindene ring) or can be, as it is, in an enediol type compound, $n$ is 0 to 3, and $R_1$ and $R_2$ each represents a hydrogen atom, an alkyl group, or an aryl group (e.g., a phenyl group, a naphthyl group, etc.), and further $R_1$ and $R_2$ can form a condensed ring.

Specific examples of compounds of the above general formula are, for instance, aminophenols such as p-methylaminophenol sulfate, 2-[N-(2-hydroxyethyl-)amino]phenol, 4-diethylamino-2,6-dimethyl-phenol hydrochloride, 2,6-dimethyl-4-dimethylaminophenol hydrochloride, 2-chloro-4-benzylaminophenol hydrochloride, 2-allyl-4-aminophenol hydrochloride, 4-(1-pyrrolidinyl)phenol hydrochloride, 2-aminoresorcinol, 2,4-diaminophenol, 4-dimethylaminophenol hydrochloride, 4-amino-2-t-butylphenol hydrochloride, 4-[(2-methylhydrobenzofuran-5-yl)methylamino]phenol hydrochloride, 2,6-dimethyl-4-(dioctylamino)phenol hydrochloride, 4-amino-2,3,6-trimethylphenol hydrochloride, 4-amino-3-ethyl-1-phenyl-5-pyrazolone, 4-amino-2,5-dimethylphenol, 4-amino-2-butoxyphenol, etc., and hydroxylamines such as N-phenylhydroxylamine, N,N-dibenzylhydroxylamine, etc.

Of these compounds, hydroquinones and catechols give particularly good results.

The concentration of these developing agents in the developer is the same as that used in conventionally known formulations, and requires no special limitation. However, the concentration of the developing agents generally can range from 0.1 to 0.0001 mole/1, preferably from 0.01 to 0.001 mole/1.

The pH value of the developer used in the invention must be at least 11.0, and this value is critical, as will be understood from the Examples herein described.

A direct reversal silver halide photographic silver halide material does not show any reversal sensitivity when the pH value of the developer used in the present invention is less than 11.0, i.e., it is impossible to obtain a positive image directly from the positive original.

The reason for this fact is not clear, but we believe that the phenolic hydroxyl group of the developing agent in the developing solution assumes a sufficient negative charge at a pH not less than 11.0, and the resulting negatively charged agent then efficiently attacks the developing accelerator contained in the photographic light-sensitive material used in the present invention, whereby the developable silver halide grains are reduced. A preferred pH value of the developing solution is 12 or more. Such a higher pH value is preferred as it makes the developer more negatively charged. The pH adjustment can effectively be conducted using a compound which exhibits strong alkalinity when dissolved in water, for example, an alkali metal hydroxide such as sodium hydroxide and potassium hydroxide, and the like.

To the developer used in the invention may further be added various additives such as preservatives, e.g., sodium sulfite, sodium bisulfite, potassium metaborate, etc., development accelerators, e.g., sodium carbonate, fog inhibitors, e.g., potassium bromide, etc., development mottle inhibitors, and the like.

The developing time cannot be set forth specifically since it varies depending upon the developing capability of the developing agent used, temperature of the developer, etc., but, in general, the developing period of time ranges from 1 to 30 minutes.

After such development processing, the light-sensitive material is subjected to the processings of stopping, fixation, washing, drying, and the like. These processings may be effected in the conventional manner, and no special considerations are required.

By processing the silver halide photographic light-sensitive material specified in the invention in accordance with the developing method of the invention, the development activity of the light-sensitive material can be enhanced even more maintaining the easily destroyable fogging nuclei having no charge in a state to be easily destroyed, if its fogging nuclei have been formed at positions other than that of the crystal defects on the surface of the silver halide grains. Thus, the resulting light-sensitive material has an extremely high reversal sensitivity and, as a result, it can be applied to uses not presently employed (e.g., as a light-sensitive material for photography). The invention has various advantages such as described above, and, since the above-described developing agent is employed, it is especially preferable for a development at high pH. Hence, the invention is extremely useful in the printing field wherein lithographic development is utilized.

The present invention will be described in greater detail hereinafter by reference to the following Examples.

EXAMPLE 1

1. Preparation of a direct reversal light-sensitive material:

In the same manner as that used for preparing a conventional photographic emulsion, an aqueous solution of silver nitrate and an aqueous solution of potassium bromide were added to a gelatin aqueous solution to thereby prepare a gelatino-silver bromide emulsion while maintaining constant the silver ion concentration in the solution. In the resulting emulsion were contained 0.38 mol of silver bromide and 45 g of gelatin per 1 kg of the emulsion more than ¾ of the AgBr grains taking the cubic form with an edge of about 1 $\mu$. The emulsion thus prepared was separated into three portions of 800 g each. To each emulsion was added 4 ml, 8 ml or 16 ml of a stannous chloride/methanol solution ($10^{-4}$ mol/liter), and the resulting emulsions were then ripened for 1 hour at a temperature of 50°C to form fogging nuclei in the AgBr contained therein.

Furthermore, 32 ml of an aqueous solution of phenosafranine ($10^{-3}$ mol/liter) represented by the following structural formula;

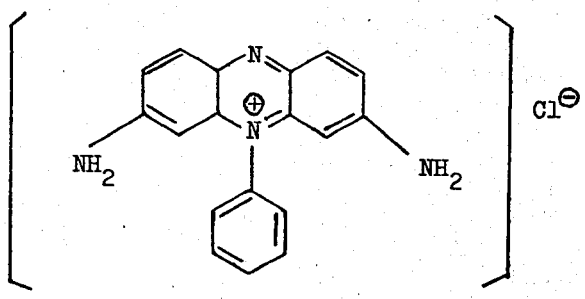

was added to each of the emulsions as a positively charged dye, densensitizer and spectrally sensitizing agent for direct reversion.

Each of the resulting emulsions was applied to a transparent cellulose acetate film provided with a gelatin subbing layer to prepare direct reversal photographic light-sensitive materials. Of these light-sensitive materials, the material to which 4 ml/800 g of emulsion of stannous chloride/methanol solution was added is referred to as "Sample A-1", the material to which 8 ml/800 g of emulsion was added is referred to as "Sample A-2", and the material to which 16 ml/800 g of emulsion was added is referred to as "Sample A-3".

2. Processings of each sample:

i. Exposure

Each of the samples was exposed to light from a tungsten lamp (color temperature: 2854°K) for 10 seconds through a continuous wedge and a blue filter having the characteristics shown in FIG. 1.

ii. Development, Fixation and Stopping

After exposure, each sample was subjected to the following processings using a developer, a stopping solution and fixing solution having the following compositions.

| | | |
|---|---|---|
| | Processing Step | |
| (1) | Development (bath temperature: 20°C) | 10 min. |
| (2) | Stopping | 1 min. |
| (3) | Fixation | 5 min. |
| (4) | Drying (air-dry at 30°C) | — |
| | Processing Solution Compositions | |
| (1) | Developer | |
| | Hydroquinone | 5.5 g |
| | Potassium Bromide | 0.8 g |
| | Sodium Sulfite (anhydrous) | 15.7 g |
| | Water to make | 1 liter |
| | 0.1 N aqueous solution of sodium hydroxide to make pH 12.7 | |
| (2) | Stopping Solution | |
| | Acetic Acid (glacial) | 35 ml |
| | Water | 1 liter |
| (3) | Fixing Solution | |

| | |
|---|---|
| Sodium Thiosulfate | 240 g |
| Sodium Sulfite (anhydrous) | 15 g |
| Acetic Acid (glacial) | 13.3 g |
| Boric Acid | 7.5 g |
| Alum | 15 g |
| Water to make | 1 liter |

Figure 2:
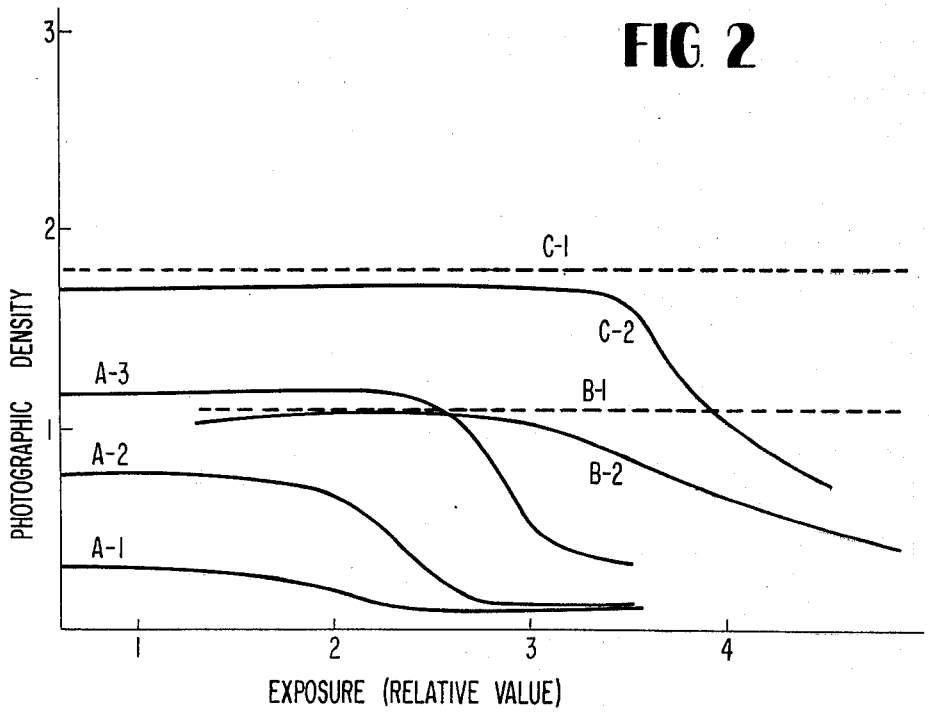
FIG. 2 is a graph showing the characteristic curves of the direct reversal silver halide photographic materials obtained in Example 1 of the invention, wherein each identification corresponds to the identification given to each sample in Example 1.

(4). Results of the measurement of the characteristics:

Of the characteristic curves shown in FIG. 2, Curve A-1 is the characteristic curve for Sample A-1, Curve A-2 for Sample A-2, and Curve A-3 for Sample A-3.

COMPARATIVE EXAMPLE 1

The procedures described in Example 1 were conducted except that $3.4 \times 10^{-3}$ mol/liter of gold (I) thiocyanate complex was added in place of the stannous chloride/methanol solution and that phenosafranine aqueous solution was added in an amount of 0 (none added) or 8 ml, to prepare light-sensitive materials, the former being referred to as Comparative Sample B-1 and the latter as Comparative Sample B-2. Each sample was subjected to the same processings as described in Example 1 to obtain the characteristic curves B-1 and B-2 shown in FIG. 2.

COMPARATIVE EXAMPLE 2

The procedures described in Example 1 were conducted except that the emulsion was so prepared that the silver bromide grains therein took the form of a regular octahedron with an edge of about 0.7$\mu$, that 3 ml of a stannous chloride/methanol solution were added thereto, and that phenosafranine aqueous solution was added in an amount of 0 ml (none added) or 3 ml, to prepare Sample C-1 (corresponding to the former) and Sample C-2 (corresponding to the latter). After the processings, the characteristic curves C-1 and C-2 shown in FIG. 2 were obtained.

As can be understood from the characteristic curves shown in FIG. 2, the samples in accordance with the invention exhibit extremely higher reversal sensitivity than that of the comparative samples.

EXAMPLE 2

Samples were prepared according to the same description as in Example 1. Each of the resulting samples was exposed in the same manner as described in Example 1 except that the minus blue filter having the transmission characteristics as shown in FIG. 1 was used in place of the blue filter of Example 1, to determine the characteristics of each sample. It can be understood from the characteristic curves obtained that the sensitivity of the samples in this Example was markedly improved in comparison with the conventional ones although the sensitivity was not as high as in Example 1.

EXAMPLE 3

The procedures described in Example 1 were conducted except that 32 ml of $10^{-3}$ mol/liter of an aqueous solution of pinakryptol yellow (structural formula II) and 40 ml of a 0.05% (by weight) of naphthoxacarbocyanine (structural formula III)/methanol solution were added instead of phenosafranine to prepare a direct reversal silver halide photographic light-sensitive material.

Structural Formula II

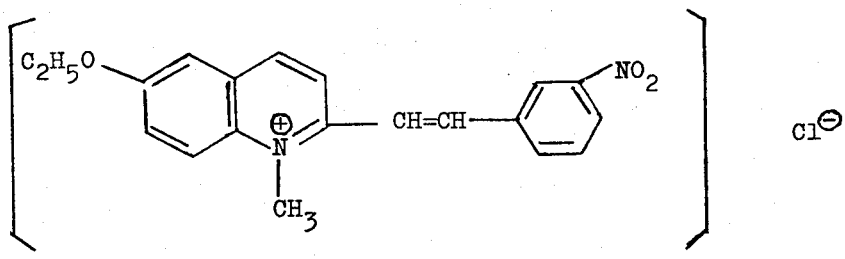

Structural Formula III

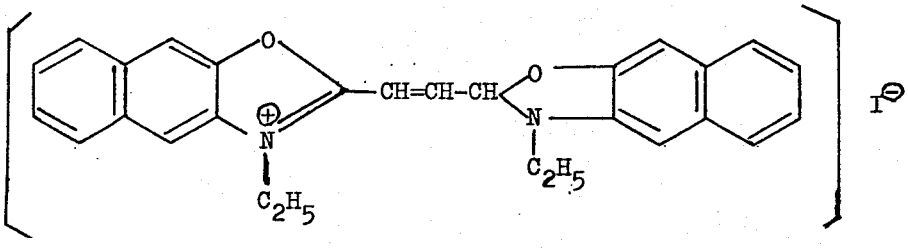

The resulting light-sensitive materials were processed in the same way as described in Examples 1 and 2. As the result, it was understood that the above-described direct reversal silver halide photographic light-sensitive materials show extremely high reversal sensitivity to blue light and minus blue light.

EXAMPLE 4

Gelatino-silver bromide emulsions were prepared in the same manner as described in Example 1. The resulting emulsions contained 0.3 mol of silver bromide and 50 g of gelatin per 1 kg of the emulsion, more than ¾ of the silver bromide grains (based on grain number) taking the cubic form with an edge of about 0.2 $\mu$. To 800 g of the emulsion was added 20 ml of stannous chloride methanol solution ($10^{-4}$ mol/liter), and the resulting emulsion was ripened for 1 hour at 50°C to form fogging nuclei in the silver bromide contained therein. Thereafter, 64 ml of phenosafranine aqueous solution ($10^{-3}$ mol/liter) was added to the emulsion, and a light-sensitive material was prepared in the same manner as described in Example 1. The characteristics of the resulting light-sensitive material were measured, and a reversal sensitivity as high as that obtained in Example 1 was obtained.

EXAMPLE 5

A silver nitrate aqueous solution was added to a mixture of a solution of potassium bromide aqueous solution and a sodium chloride aqueous solution containing gelatin as a binder to prepare a gelatino-silver chlorobromide emulsion (containing 0.3 mol of silver halide and 50 g of gelatin per 1 kg of emulsion) containing silver chlorobromide grains (containing 20 mol % of silver chloride), more than ¾ of the grains (based on grain number) taking the cubic form with an edge of 0.2μ. A direct reversal silver halide light-sensitive material was prepared in the same way as described in Example 4 using the resulting emulsion, which was then exposed and processed as described in Examples 1 and 2. Thus, extremely higher reversal sensitivity than ever was obtained.

EXAMPLE 6

A direct reversal silver halide light-sensitive material was prepared in the same manner as described in Example 1 except that 16 ml of a thiourea dioxide/alcohol solution ($10^{-4}$ mol/liter) was used as a reducing agent in place of stannous chloride. As the result of the exposure and processing in the same manner as described in Examples 1 and 2, there was obtained a reversal sensitivity as high as in Example 1.

EXAMPLE 7

The procedures described in Example 5 were conducted except that the compound having the following structural formula;

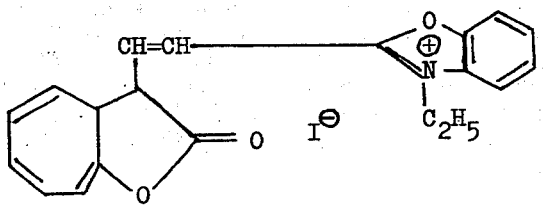

was added in the same amount in place of the phenosafranine. Thus, extremely high reversal sensitivity could be obtained, similar to that of Example 5.

EXAMPLE 8

The procedures described in Example 5 were conducted except that the compound having the following structural formula;

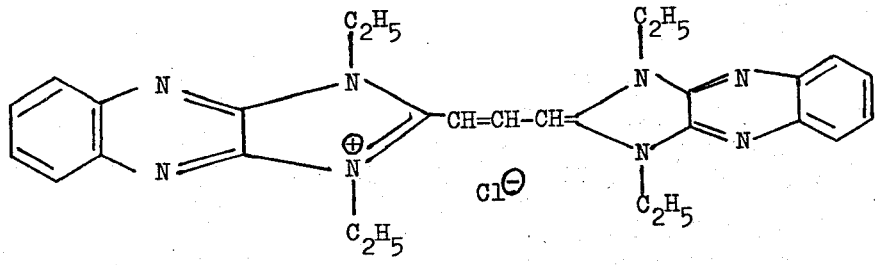

or the compound having the following structural formula;

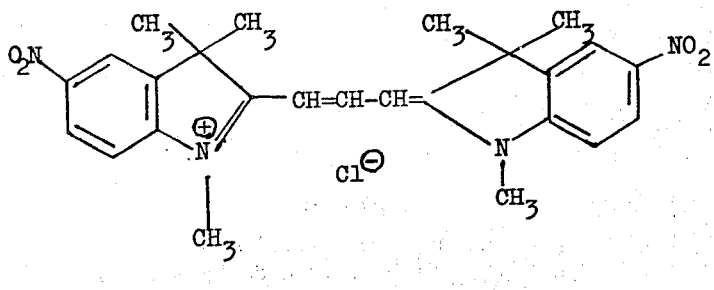

was added in the same amount in place of the phenosafranine used in Example 5. Thus, both samples showed extremely high reversal sensitivity as in Example 5.

EXAMPLE 9

The procedures described in Example 3 were conducted except that the compound having the following structural formula;

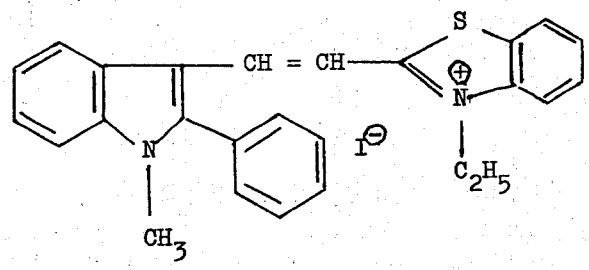

was added to the emulsion in place of the naphthoxacarbocyanine used in Example 5. Thus, there could be obtained extremely high reversal sensitivity as was obtained in Example 3.

EXAMPLE 10

The procedures described in Example 4 were conducted except that 32 ml of a $10^{-3}$ mol/liter pinakryptol yelllow aqueous solution and 40 ml of a 0.05% (by weight) methanol solution of the compound having the following structural formula;

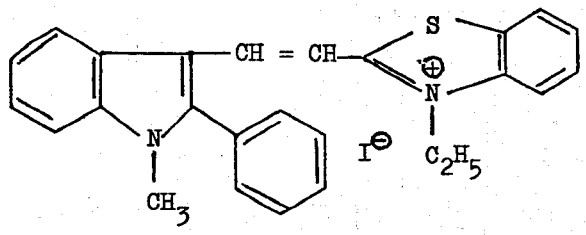

(IV)

were added to the emulsion in place of the phenosafranine used in Example 3. Thus, the reversal sensitivity as high as in Example 3 was shown.

EXAMPLE 11

The procedures described in Example 10 were conducted except that the compound having the following formula;

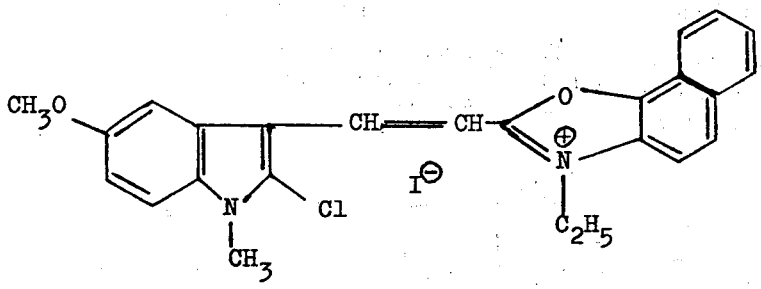

was added in the same amount in place of the Compound (IV) used in Example 10. The other procedures were conducted in the same manner as described in Example 4. Thus, the reversal sensitivity as high as that in Example 3 was shown.

EXAMPLE 12

A gelatino-silver chlorobromide was prepared in the same way as described in Example 5. To 800 g of the resulting emulsion was added 16 ml of a stannous chloride/methanol solution ($10^{-4}$ mol/liter), and ripened for 1 hour at 50°C to form fogging nuclei in the silver chlorobromide contained therein. Thereafter, 32 ml of a pinakryptol yellow aqueous solution ($10^{-3}$ mol/liter) and the same amount of a compound having the following structural formula:

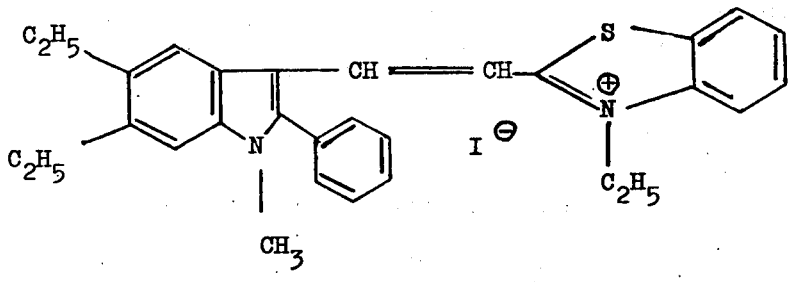

were added to the emulsion, and the emulsion was applied to a cellulose triacetate film to prepare a direct reversal silver halide photographic light-sensitive material. Thereafter, the resulting light-sensitive material was exposed and processed according to the procedures described in Examples 1 and 2, and the characteristics thereof were measured. Thus, extremely high reversal sensitivity as that in Example 3 was shown.

EXAMPLE 13

The results shown in Table I below were obtained by following the procedure of Example 1 using an emulsion comprising AgBr grains having the cubic form with an average side length of about 1$\mu$, i.e., an average grain size of 0.9 $\mu$.

In Table 1, *1 and *2 mean that fogging nuclei are provided as in U.S. Pat. No. 3,501,305 Illingsworth and as in the present invention, respectively. The light sensitive material in accordance with the present invention exhibits a higher sensitivity and better clearing (i.e., Dmin is small) than that of Illingsworth.

Table 1

Comparison of direct reversal sensitive materials according to U.S. Pat. No. 3,501,305 Illingsworth's *1 and the present invention.

| Test No. | Tin *3 chloride m mol / mol AgBr | Pheno-safranine mg / mol AgBr | Gold salt m mol / mol AgBr | Blue-exposure *4 Dmax | Blue-exposure *4 Dmin | Blue-exposure *4 Relative *6 Sensitivity | minus-Blue exposure *5 Dmax | minus-Blue exposure *5 Dmin | minus-Blue exposure *5 Relative *6 | 0.15 Remarks |
|---|---|---|---|---|---|---|---|---|---|---|
| 1 | 0.0053 | 140 | 0 | 0.98 | 0.15 | 100 (Standard) | 0.94 | 0.15 | 100 (Standard) | *2 |
| | " | " | 0.002 | 0.85 | 0.23 | 87 | 0.83 | 0.18 | 81 | *1 |
| 2 | 0.0107 | 140 | 0 | 1.24 | 0.15 | 100 (Standard) | 1.22 | 0.16 | 100 (Standard) | *2 |
| | " | " | 0.002 | 1.18 | 0.23 | 72 | 1.15 | 0.20 | 79 | *1 |

*1 Experiment based on U.S. Pat. No. 3,501,305 Illingsworth.
*2 Experiment based on the present invention.
*3 Ripened for 60 min. at a temperature of 50°C.
*4 Use of gelatin filter BPN-45 made by Fuji Photo Film Co., Ltd.
*5 Use of glass filter VO-52 made by Tokyo Shibaura Co., Ltd.
*6 Reciprocal expression of the amount of exposure which gives (Dmax+Dmin)/2.

EXAMPLE 14

In the same manner as is used for preparing a conventional photographic emulsion, an aqueous solution of silver nitrate and an aqueous solution of potassium bromide were added to a gelatin aqueous solution while maintaining the silver ion concentration in the solution constant to prepare a gelatino-silver bromide emulsion.

The resulting emulsion contained 0.38 mols of silver bromide and 45g of gelatin per 1kg of emulsion, and more than ¾ of the AgBr grains had the cubic form with a side length of about 0.7¾. The emulsion thus prepared was separated into three 20000 g portions. To each emulsion there was added X ml or Y ml as is indicated in Table 2 of a methanolic solution of stannous chloride ($10^{-4}$ mol/liter or $10^{-3}$ mol/liter), and the resulting emulsions were then ripened for 1 hour at a temperature of 50°C to form fogging nuclei in the AgBr contained therein.

Further, 100 g of the each emulsion was separated and Z ml as is indicated in Table 2 of an aqueous solution of phenosafranine ($10^{-3}$ mol/liter) was added thereto. Each of the resulting emulsions was applied to a transparent cellulose acetate film provided with a gelatin subbing layer to prepare direct reversal photographic light-sensitive materials.

Each of the samples was exposed to light from a tungsten lamp (color temperature: 2854° K) for 10 seconds through a continuous wedge and a color filter.

The color filter used was a blue filter [ gelatin filter BPN-45 produced by Fuji Photo Film Co., Ltd., transmitting light of about 400–500 nm, maximum transmittance: 450 nm 40% ] and, as the minus blue filter, there was used a color glass filter produced by Tokyo Shibaura Electric Co., Ltd. [transmitting light of a wavelength of longer than about 490 μm, 10% of a wavelength of 500 μm, 73% of a wavelength of 520 μm and 80–90% of a long wavelength longer than 540 μm].

After exposure, each sample was subjected to developing, stopping and fixing in the same manner as described in Example 1. However, the pH value of the developer was adjusted as is shown in Table 2 by adding a 0.1N NaOH aqueous solution thereto.

The reversal sensitivity of the sampels is expressed in terms of the relative value of the reciprocal of the exposure amount required for decreasing by 0.1 the fogging density as shown in Table 2. The blue sensitivity and minus blue sensitivity represent the results obtained using the blue filter and the minus blue filter, respectively.

Table 2

| Test No. | X(ml) ($10^{-4}$ mol/l) | Y(ml) $10^{-3}$ mol/l) | Z(ml) | Developer pH | Maximum density Dmax | Minimum density Dmin | Blue sensitivity | Minus blue sensitivity |
|---|---|---|---|---|---|---|---|---|
| 1 | 40 | 0 | 8 | | 0.56 | 0.13 | 100 | 141 |
| | 80 | 0 | 8 | 12.7 | 0.87 | 0.13 | 95 | 200 |
| | 40 | 0 | 16 | | 0.98 | 0.15 | 107 | 250 |
| | 80 | 0 | 16 | | 1.23 | 0.15 | 83 | 219 |
| 2 | 40 | 0 | 8 | | 0.76 | 0.11 | 132 | 174 |
| | 80 | 0 | 8 | 11.5 | 1.07 | 0.10 | 118 | 141 |
| | 40 | 0 | 16 | | 0.83 | 0.09 | 112 | 200 |
| | 80 | 0 | 16 | | 1.03 | 0.09 | 85 | 151 |
| 3 | 80 | 0 | 8 | 11.0 | 0.58 | 0.06 | 100 | 105 |
| | 80 | 0 | 16 | | 0.69 | 0.07 | 76 | 126 |
| 4 | 0 | 2 | 8 | | 0.68 | 0.68 | 0 | 0 |
| | 0 | 4 | 8 | 10.5 | 1.26 | 1.26 | 0 | 0 |
| | 0 | 2 | 16 | | 1.18 | 1.18 | 0 | 0 |
| 5 | 0 | 16 | 8 | | 0.83 | 0.80 | 0 | 0 |
| | 0 | 32 | 8 | 10.0 | 1.56 | 1.00 | 0 | 0 |
| | 0 | 16 | 16 | | 0.75 | 0.31 | 0 | 0 |
| | 0 | 32 | 16 | | 1.45 | 0.71 | 0 | 0 |

As is clear from Table 2, high reversal sensitivity was obtained only in the case of using the developer having a pH higher than 11. At a pH value of 11 or below, no reversal sensitivity was obtained.

EXAMPLE 15

Sensitivity values obtained by the procedure described in Example 14 but using a developer of a pH of 12.7 and catechol, metal or N,N-dimethyl-p-phenylenediamine instead of hydroquinone as a developing agent are shown in Table 3, and compared to such a developer containing catechol.

Table 3

| Test No | X | Z | Developer pH | Developing Agent | Blue Sensitivity | Minus blue Sensitivity |
|---|---|---|---|---|---|---|
| 1 | 40 | 8 | | hydroquinone | 100 | 141 |
| | 80 | 8 | 12.7 | | 95 | 200 |
| | 40 | 16 | | 107 | 250 | |
| | 80 | 16 | | | 83 | 219 |
| 6 | 40 | 8 | | catechol | 56 | 20 |
| | 80 | 8 | 12.7 | | 46 | 32 |
| | 40 | 16 | | | 48 | 30 |
| | 80 | 16 | | | 36 | 32 |
| 7 | 40 | 8 | | Metol | 39 | 85 |
| | 80 | 8 | 12.7 | p-(N-methyl) | 22 | 107 |
| | 40 | 16 | | amino phenol | 56 | 178 |
| | 80 | 16 | ½hydro- | 56 | 178 | |
| | | | | sulfate | | |
| 8 | 40 | 8 | | N,N-dimethyl- | 0 | 0 |
| | 80 | 8 | 12.7 | p-phenylene | 0 | 0 |
| | 40 | 16 | | diamine | 0 | 0 |
| | 80 | 16 | | | 0 | 0 |

It will be seen from Table 3 that high reversal sensitivities were obtained in case of using a substituted benzene having at least one-phenolic hydroxyl group.

EXAMPLE 16

The procedure described in Example 14 was repeated except that an aqueous solution of chlorauric acid was used in an amount as shown in Table 4 per 100 g of the emulsion.

The resulting sensitivity values are shown in Table 4.

Table 4

(developing agent hydroquinone, pH 12.7)

| Test No. | X | Z | Solution of chlorauric acid concentration | Solution of chlorauric acid additive amount | Blue sensitivity | Minus blue sensitivity |
|---|---|---|---|---|---|---|
| 1 | 40 | 8 | | | 100 | 141 |
| | 80 | 8 | 0 | 0 | 95 | 200 |
| | 40 | 16 | | | 107 | 250 |
| | 80 | 16 | | | 83 | 219 |
| 9 | 40 | 8 | | | 71 | 93 |
| | 80 | 8 | 0.001 | 3 ml | 60 | 145 |
| | 40 | 16 | wt% | | 72 | 158 |
| | 80 | 16 | | | 60 | 182 |
| 10 | 10 | 8 | | | 71 | 79 |
| | 20 | 8 | 0.01 | 3 ml | 46 | 55 |
| | 10 | 16 | wt% | | 19 | 36 |
| | 20 | 16 | | | 21 | 32 |

EXAMPLE 17

Following the procedure of Example 16, light sensitive materials were developed using Kodak DK-50 at 20°C for 10 min. and a hydroquinone developer (HQ) having a pH value of 11.0 at 20°C for 10 min. instead of a hydroquinone developer having a pH value of 12.7. The resulting sensitivity values are shown in Table 5.

Table 5

| Test No. | X | Z | Solution of chlorauric acid concentration | Solution of chlorauric acid additive amount | Developer | Blue sensitivity | Minus blue sensitivity |
|---|---|---|---|---|---|---|---|
| 11 | 80 | 8 | 0.001 | 3 ml | DK-50 | 25 | 40 |
| | 80 | 16 | wt% | | | 47 | 50 |
| 12 | 80 | 8 | 0.01 | 1 ml | DK-50 | 38 | 16 |
| | 80 | 16 | wt% | | | 14 | 9 |
| 13 | 40 | 8 | 0 | 0 | HQ | 91 | 107 |
| | 40 | 16 | | | (pH 11.0) | 71 | 93 |

It was found that the reversal sensitivity was decreased by adding gold ions even though DK-50 was used.

While the invention has been described in detail and in terms of specific embodiments thereof, it will be apparent that various changes and modifications can be made therein without departing from the spirit and scope thereof.

I claim:

1. A process of developing an image-wise exposed light-sensitive material which comprises processing a direct reversal silver halide photographic light-sensitive material comprising a support having coated thereon a light-sensitive layer formed by applying to said support a silver halide photographic emulsion comprising:

1. cubic silver halide grains having fogging nuclei therein provided by adding a strong reducing agent to said emulsion and ripening said emulsion, and
2. (a) an electron acceptor which is capable of receiving photoelectrons and also which is capable of acting as a development accelerator and bearing atoms capable of being positively charged in a developer solution; and b. (i) an electron acceptor capable of receiving photelectrons and (ii) a development accelerator containing atoms capable of being positively charged in a developer solution;

in an aqueous solution of a hydrophilic colloid; with a developer solution containing a developing agent having at least one phenolic hydroxy group, the pH of said developer solution being at least 11.

2. The process of claim 1, wherein said hydrophilic colloid comprises gelatin, polyvinyl alcohol, polyvinyl pyrrolidone or carboxymethyl cellulose, or a combination of gelatin and polyvinyl alcohol, polyvinyl pyrrolidone, or carboxymethyl cellulose.

3. The process of claim 1, wherein said reducing agent is a hydrazine, a phosphonium salt, thiourea dioxide, a stannous salt, a polyamine, bis($\beta$-aminoethyl)sulfite or a water soluble salt thereof.

4. The process of claim 3, wherein said reducing agent is a stannous salt.

5. The process of claim 3, wherein said reducing agent is present at a level of from about 0.005 to 0.06 $\times 10^{-3}$ mole per mole of silver halide.

6. The process of claim 1, wherein said electron acceptor is a compound for which the sum of the polarographic oxidation potential plus the polarographic reduction potential is positive.

7. The process of claim 1, wherein said electron acceptor is present in said emulsion at a level ranging from about 100 mg to 2 g per mole of silver halide.

8. The process of claim 1, wherein said development accelerator is present in said emulsion at a level ranging from about 0.01 g to 2 g per mole of silver halide.

9. The process of claim 1, wherein said emulsion additionally contains a spectral sensitizing agent.

10. The process of claim 1, wherein said developing agent is selected from the group consisting of hydroquinones, catechols and the compounds represented by the following formula:

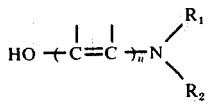

wherein

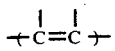

is a part of an aromatic ring, a heterocyclic ring or a part of an enediol type compound, $n$ is 0 to 3, and $R_1$ and $R_2$ each represents a hydrogen atom, an alkyl group, an aryl group or $R_1$ and $R_2$ can form a condensed ring.

11. The process of claim 10, wherein said developing agent is selected from the group consisting of hydroquinone, phenylhydroquinone, 2′-hydroxyphenylhydroquine, phenoxyhydroquine, 4′-methylphenyl-hydroquine, 1,4-dihydroxynaphthalene, 2-(4-aminophenethyl)-5-bromo-hydroquinone, 2-(4-aminophenethyl)-5-methyl-hydroquinone, 4′-aminophenethylhydroquinone, 2,5-dimethylhydroquinone, 2,5-dibutoxyhydroquinone, m-xylohydroquinone, bromohydroquinone, 3,6-dichlorohydroquinone, 2-dimethylaminomethylhydroquinone, 2-cyclohexylhydroquinone, sec-butyl-hydroquinone, 2,5-dichlorohydroquinone, 2,5-diisopropylhydroquinone, 2,5-diiodohydroquinone, 3-chlorotoluhydroquinone, tetrachlorohydroquinone, 2,5-diphenylhydroquinone, 2,5-diresorcilhydroquinone, 2,5-dioctylhydroquinone, dodecylhydroquinone, catechol, 4-methylcatechol, 4-isopropylcatechol, 3-isopropylcatechol, 4-tert-butylcatechol, 4-phenylcatechol, 3,6-dimethylcatechol, 3-phenylcatechol, 4-octylcatechol, p-chlorocatechol, 4,5-dibromocatechol, 4-phenoxycatechol, hexanoylcatechol, disodium catechol disulphinate, 4-phenylcatechol carbonate, caffeic acid, 3,4-dihydroxy cinnamic acid, nordihydroquaretic acid, p-methylaminophenol sulfate, 2[N-(2-hydroxyethyl)amino]phenol, 4-diethylamino-2,6-dimethylphenol, hydrochloride, 2,6-dimethyl-4-dimethylaminophenol hydrochloride, 2-chloro-4-benzylaminophenol hydrochloride, 2-allyl-4-aminophenol hydrochloride, 4-(1-pyrrolidinyl)phenol hydrochloride, 2-aminoresorcinol, 2,4-diaminophenol, 4-dimethylaminophenol hydrochloride, 4-amino-2-t-butylphenol hydrochloride, 4-[( 2-methylhydrobenzofuran-5-yl)methylamino]-phenol hydrochloride, 2,6-dimethyl-4-(dioctylamino)-phenol hydrochloride, 4-amino-2,3,6-trimethylphenol hydrochloride, 4-amino-3-ethyl-1-phenyl-5-pyrazolone, 4-amino-2,5-dimethylphenol, 4-amino-2-butoxyphenol, N-phenylhydroxylamine and N,N-dibenzylhydroxylamine.

12. The process of claim 1 wherein said compound acting as a development accelerator is represented by the following general formula

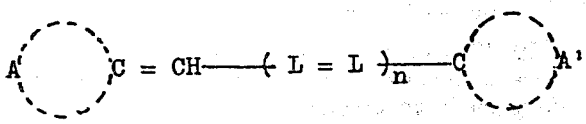

wherein A and A′ each represents the atoms necessary to complete a nitrogen containing basic heterocyclic nucleus selected from the group consisting of quinoline, pyridine, thiazole, benzthiazole, oxazole, benzoxazole, selenazole benzselenazole, naphthoselenazole, naphthothiazole and naphthoxazole.

13. The process of claim 1 wherein said compound acting as a development accelerator is represented by the following general formula

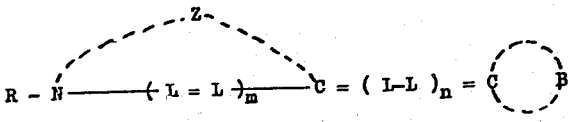

wherein R represents a substituted alkyl group selected from the group consisting of a sulfoalkyl group, a sulfatoalkyl group, and a carboxyalkyl group, or an unsubstituted alkyl group having 1 to 8 carbon atoms, L represents a methine chain, $m$ represents 0 or 1, $n$ represents 0, 1 or 2, Z represents the non-metallic atoms necessary to complete a heterocyclic nucleus, and B represents the non-metallic atoms necessary to complete a nitrogen-containing basic heterocyclic nucleus.

14. The process of claim 1 wherein said emulsion contains additionally a spectral sensitizing agent of the following general formula

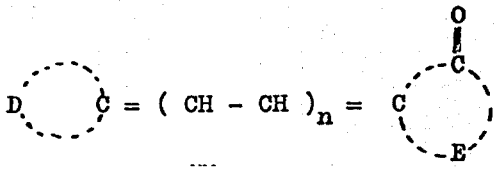

wherein D represents the atoms necessary to complete a nitrogen-containing basic heterocyclic nucleus, E represents the atoms necessary to complete an acidic heterocyclic nucleus, and n represents 1, 2 or 3.

15. The process of claim 1 wherein an electron acceptor which also acts as a development accelerator is used.

16. The process of claim 15 wherein said emulsion contains additionally a spectral sensitizing agent.

17. The process of claim 16 wherein said emulsion contains additionally a spectral sensitizing agent.

18. The process of claim 1 wherein an electron acceptor and a separate development accelerator are used.

19. The process of claim 1 wherein said strong reducing agent is added and then ripening is effected to obtain fogging.

20. The process of claim 1 wherein a single strong reducing agent and ripening are used as the sole means to effect fogging.

21. The process of claim 1 wherein a combination of strong reducing agents and ripening are used as the sole means to effect fogging.

22. The process of claim 1 wherein said electron acceptor is selected from the group consisting of *1,1-dimethyl-2,2′-diphenyl-3,3′-indolocarbocyanine bromide; *2,2′-di-p-methoxyphenyl-1,1′-dimethyl-3,3′-indolocarbocyanine bromide; *1,1-dimethyl-2,2′,8-triphenyl-3,3′-indolocarbocyanine perchlorate; *1,1′,3,3′-tetraethylimidazolo-(4,5-b)-quinoxalinocarbocyanine chloride; *phenosafranine; *pinakryptol yellow; *1,3-diethyl-6-nitrothia-2′-cyanine iodide;

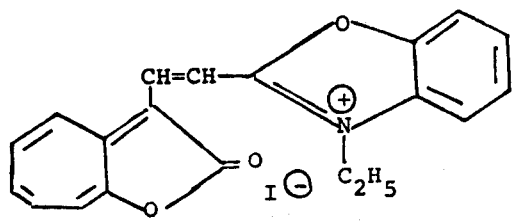

and

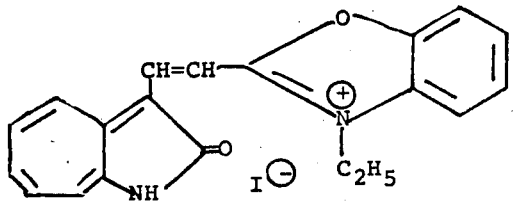

;

*

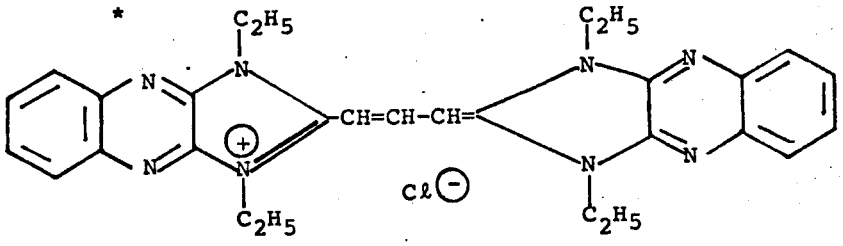

;

[ and]

*

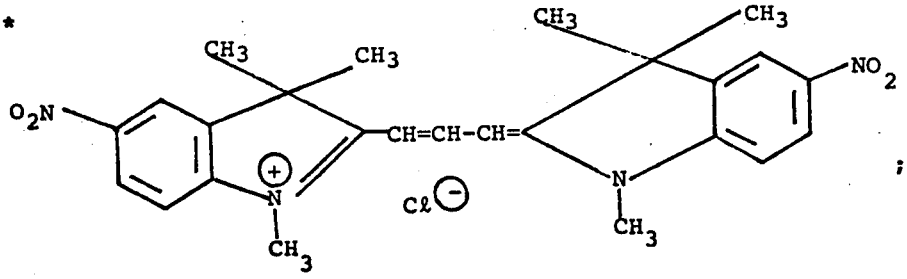

;

*3,3′-diethyl-6,6′-dinitro-9-phenylthiacarbocyanine iodide; *Crystal Violet; *3,3′-diethyl-6,6′-dinitrothiacarbocyanine ethylsulfate; *1′,3-dimethyl-6-nitrothia-2′-cyanine iodide; *3,3′-di-p-nitrobenzylthiacarbocyanine bromide; *3,3′-di-p-nitrophenylthiacarbocyanine iodide; *3,3′-di-o-nitrophenylthiacarbocyanine perchlorate; 3,3′-dimethyl-9-trifluoromethylthiacarbocyanine iodide; *9-(2,4-dinitrophenylmercapto)-3,3′-diethylthiacarbocyanine iodide; *bis(4,6-diphenylpyrryl-2)trimethinecyanine perchlorate; the compounds represented by the general formula:

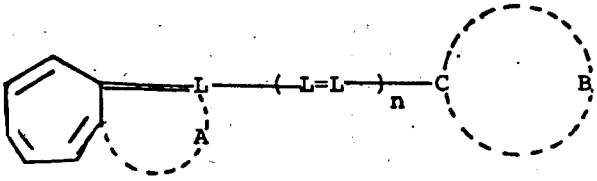

wherein A represents the non-metallic atoms necessary to complete a 5-membered heterocyclic nucleus, *n* represents 0, 1 or 2, L represents a methine group and B represents the non-metallic atoms necessary to complete a basic nitrogen containing heterocyclic nucleus and selected from the group consisting of 5-m-nitrobenzylidenerhodanine; 5-m-nitrobenzylidene-3-phenylrhodanine; 3-ethyl-5-m-nitrobenzylidenerhodanine; 3-ethyl-5-(2,4-dinitrobenzylidene)rhodanine; 5-o-nitrobenzylidene-3-phenylrhodanine; 6-chloro-4-nitrobenzotriazole; 2-(p-dimethylaminophenyliminomethyl)-benzothiazole ethoethylsulfate; 1,3-diamino-5-methylphenazinium chloride; 4-nitro-6-chlorobenzotriazole; anhydro-2-p-dimethylaminophenyliminomethyl-6-nitro-3-(4-sulfobutyl)-benzothiazoline hydroxide; 1-(2-benzothiazolyl)-2-(p-dimethylaminostyryl)-4,6-diphenylpyridine iodide; 1,3-diethyl-5-2-thiobarbituric acid; 2,3,5-tri- phenyl-2H-tetrazolium chloride; 2-(4-iodophenyl)-3-(4-nitrophenyl)-5-phenyl-tetrazolium chloride; 1-methyl-8-nitroquinolinium methyl-sulfate; and 3,6-bis-1,2,4,5-cyclohexanetetrone; the symbol asterisk denoting that the compound functions both as an electron acceptor and a development acceptor.

23. The process of claim 1, wherein said development accelerator contains a nitrogen atom capable of being positively charged.

24. The process of claim 1, wherein the pH of said developer is at least 12.

* * * * *